US005334236A

United States Patent [19]

Sang et al.

[11] Patent Number: 5,334,236

[45] Date of Patent: * Aug. 2, 1994

[54] PROCESS FOR PRODUCING SHAPED SLABS OF PARTICLE STABILIZED FOAMED METAL

[75] Inventors: Harry Sang, Kingston; Lorne D. Kenny, Inverary; Iljoon Jin, Kingston, all of Canada

[73] Assignee: Alcan International Limited, Montreal, Canada

[ * ] Notice: The portion of the term of this patent subsequent to Nov. 27, 2007 has been disclaimed.

[21] Appl. No.: 905,619

[22] Filed: Jun. 29, 1992

Related U.S. Application Data

[63] Continuation-in-part of Ser. No. 708,700, May 31, 1991, abandoned.

[51] Int. Cl.[5] ..... B22D 27/00

[52] U.S. Cl. ..... 75/415; 164/79; 427/244

[58] Field of Search ..... 75/415; 427/244; 164/79

[56] References Cited

U.S. PATENT DOCUMENTS 3,941,182 3/1976 Bjorksten et al. ..... 75/415
4,973,358 11/1990 Jin et al. ..... 75/415

FOREIGN PATENT DOCUMENTS 615147 12/1926 France ..... 75/415

*Primary Examiner*—Melvyn J. Andrews

[57] ABSTRACT

A process and apparatus are described for manufacturing particle stabilized foamed metal slabs. A foam is first formed in a foaming chamber by heating a composite of a metal matrix and finely divided solid stabilizer particles above the solidus temperature of the metal matrix and discharging gas bubbles into the molten metal composite below the surface thereof to thereby form a stabilized liquid foam on the surface of the molten metal composite. The stabilized liquid foam is continuously drawn off the surface of the molten metal composite and is solidified into a shaped foam product while being continuously drawn off.

17 Claims, 6 Drawing Sheets

PROCESS FOR PRODUCING SHAPED SLABS OF PARTICLE STABILIZED FOAMED METAL

CROSS-REFERENCE TO RELATED APPLICATION

This is a continuation-in-part of U.S. application Ser. No. 07/708,700 filed May 31, 1991 now abandoned.

BACKGROUND OF THE INVENTION

This invention relates to a process and apparatus for manufacturing a particle stabilized foamed metal, particularly a continuously produced slab of particle stabilized foamed aluminum.

Lightweight foamed metals have high strength-to-weight ratios and are extremely useful as load-bearing materials and as thermal insulators. Metallic foams are characterized by high impact energy absorption capacity, low thermal conductivity, good electrical conductivity and high absorptive acoustic properties.

A particle stabilized foamed metal of exceptional stability is described in Jin et al U.S. Pat. No. 4,973,358, issued Nov. 27, 1990. According to that patent, a composite of a metal matrix and finely divided solid stabilizer particles is heated above the liquidus temperature of the metal matrix. Gas is then introduced into the molten metal composite below the surface of the composite to form bubbles therein. These bubbles float to the top surface of the composite to produce on the surface a closed cell foam. This foamed melt is then cooled below the liquidus temperature of the melt to form a foamed metal product having a plurality of closed cells and the stabilizer particles dispersed within the metal matrix.

The foam which forms on the surface of the molten metal composite is a highly stable liquid foam.

SUMMARY OF THE INVENTION

According to one embodiment of this invention, a process is provided in which a composite of a metal matrix and finely divided solid stabilizer particles is heated above the solidus temperature of the metal matrix. Gas is then introduced into the molten metal composite below the surface of the composite to form bubbles therein and these bubbles float to the top surface of the composite to produce on the surface a closed cell foam.

According to the novel feature of the present invention, the foam which forms on the surface of the molten metal composite is a stabilized liquid foam of considerable structural integrity. This foam is continuously drawn off from the surface of the molten metal composite and is formed into a shaped, solidified foam product while being drawn off from the surface of the melt. This forming is preferably done by passing the stabilized liquid foam between a pair of spaced apart moving belts or rollers while applying cooling or by drawing the stabilized liquid foam from the melt surface through an orifice or mould while applying cooling.

The success of this foaming method is highly dependent upon the nature and amount of the finely divided solid refractory stabilizer particles. A variety of such refractory materials may be used which are particulate and which are capable of being incorporated in and distributed through the metal matrix and which at least substantially maintain their integrity as incorporated rather than losing their form or identity by dissolution in or chemical combination with the metal.

Examples of suitable solid stabilizer materials include alumina, titanium diboride, zirconia, silicon carbide, silicon nitride, etc. The volume fraction of particles in the foam is typically less than 25% and is preferably in the range of about 5 to 15%. The particle sizes can range quite widely, e.g. from about 0.1 to 100 μm, but generally particle sizes will be in the range of about 0.5 to 25 μm with a particle size range of about 1 to 20 μm being preferred.

The particles are preferably substantially equiaxial. Thus, they preferably have an aspect ratio (ratio of maximum length to maximum cross-sectional dimension) of no more than 2:1. There is also a relationship between particle sizes and the volume fraction that can be used, with the preferred volume fraction increasing with increasing particle sizes. If the particle sizes are too small, mixing becomes very difficult, while if the particles are too large, particle settling becomes a significant problem. If the volume fraction of particles is too low, the foam stability is then too weak and if the particle volume fraction is too high, the viscosity becomes too high.

The metal matrix may consist of any metal which is capable of being foamed. Examples of these include aluminum, steel, zinc, lead, nickel, magnesium, copper and alloys thereof.

The foam-forming gas may be selected from the group consisting of air, carbon dioxide, oxygen, water, inert gases, etc. Because of its ready availability, air is usually preferred. The gas can be injected into the molten metal composite by a variety of means which provide sufficient gas discharge pressure, flow and distribution to cause the formation of a foam on the surface of the molten composite. Preferably, a strong shearing action is imparted to a stream of gas entering the molten composite, thereby breaking up the injected gas stream into a series of bubbles. This can be done in a number of ways, including injecting the gas through a rotating impeller, or through a vibrating or reciprocating nozzle. It is also possible to inject the gas within a sonic or ultrasonic horn submerged in the molten composite, with the vibrating action of the ultrasonic horn breaking up the injected gas stream into a series of bubbles. The cell size of the foam can be controlled by adjusting the gas flow rate, as well as the impeller design and rotational speed where used or the amplitude and frequency of oscillation or vibration where an oscillating or vibrating system is used.

In forming the foam according to this invention, the majority of the stabilizer particles adhere to the gas-liquid interface of the foam. This occurs because the total surface energy of this state is lower than the surface energy of the separate liquid-gas and liquid-solid state. The presence of the particles on the bubbles tends to stabilize the froth formed on the liquid surface. It is believed that this may happen because the drainage of the liquid metal between the bubbles in the froth is restricted by the layer of solids at the liquid-gas interfaces. The result is a liquid metal foam which is not only stable, but also one having uniform pore sizes throughout the foam body since the bubbles tend not to collapse or coalesce.

One embodiment of the apparatus for drawing off and forming the stabilized liquid foam into a shaped product comprises a twin belt caster. This belt caster may move the foam in any direction, including vertically upwardly or downwardly, horizontally or at any angle therebetween.

When operating in the upward vertical mode, the highly stable liquid foam enters the gap defined by the two belts and is solidified between the belt surfaces. The distance between the belts defines the slab thickness and the moving belts pull the liquid foam upwardly from the top of the foaming chamber. This has the advantage that liquid drainage from the foam can flow downwardly and back into the melt.

When the belts move in a horizontal direction or at a low angle, i.e. less than 45° to the horizontal, the liquid metal drainage from the foam is downward onto the bottom belt where it forms into a homogeneous pore-free skin on the solidified foam product. Also, when a horizontal direction or low angle of less than 45° is used, it is possible to use only a single bottom support belt upon which the foam is carried. It is also possible to use the single bottom support belt in combination with a top roll to flatten the top surface of the foam; the top roll may be water cooled and it may be motorized.

According to another embodiment of the invention, the belts are not permanent endless belts but are formed of sheet material which bonds to the surface of the foam. Thus, one or both endless belts may be replaced by a coil of sheet metal, e.g. brazing sheet, which bonds to the foam during solidification.

Another embodiment of the apparatus for drawing off and forming the stabilized liquid foam into a shaped product comprises drawing the stabilized liquid foam upwardly through an orifice or mould which determines the shape of the end product. As soon as the liquid foam emerges from the top of the orifice or mould, a solid skin is formed by rapid solidification of the thin outside bubble wall. The orifice or mould may be simply the top of a foaming chamber or it may be in the form of an upwardly tapered portion with a top outlet in the cross-sectional shape of the desired foam product. The orifice or mould may also include a central solid plug which results in the formation of a hollow foam profile.

The stabilized liquid foam may be drawn upwardly through the forming orifice by inserting a chilled metal hook member into the stabilized liquid foam in the foaming chamber and cooling and solidifying a portion of the foam sufficiently to lift it with the hook. Then the hook is continuously raised vertically whereby a continuous profile of foam product is drawn upwardly through the orifice.

In another embodiment, the stabilized liquid foam may be drawn up between rolls positioned above the foaming chamber. These rolls may assist in lifting the stabilized liquid foam and they may have special profiles which shape the foam passing between the rolls. The rolls are preferably water-cooled and may be motorized.

Cooling is preferably applied to the emerging foam to speed solidification. This can conveniently be done by blowing cooling air onto the foam between the belts or as it emerges from the orifice or mould, or by the use of water-cooled rolls as mentioned above.

The invention also relates to a unique foamed metal product in the form of a slab of metal foam, with one main face of the slab comprising a homogeneous pore-free skin formed of the same metal as the foam. When the foam is formed between twin belts at an angle of no more than 45° to the horizontal, some liquid of the stabilized liquid foam drains downwardly onto the bottom belt where it solidifies into the homogeneous pore-free skin.

The process and apparatus of this invention have a number of advantages. When using the belt caster system, the thickness of the foam slab produced is easily controlled by the distance between the belts. Also, the two principal surfaces of the slab produced may be identical. When a product is formed while moving in a vertical direction, density gradients across the product are minimized due to centre line symmetry. Also with the vertical upward movement, liquid drainage from the foam can flow downwardly and back into the melt.

BRIEF DESCRIPTION OF THE DRAWINGS

Methods and apparatus for performing the present invention will now be more particularly described by way of example with reference to the accompanying drawings, in which.

DESCRIPTION OF THE PREFERRED EMBODIMENTS

Figure 1:
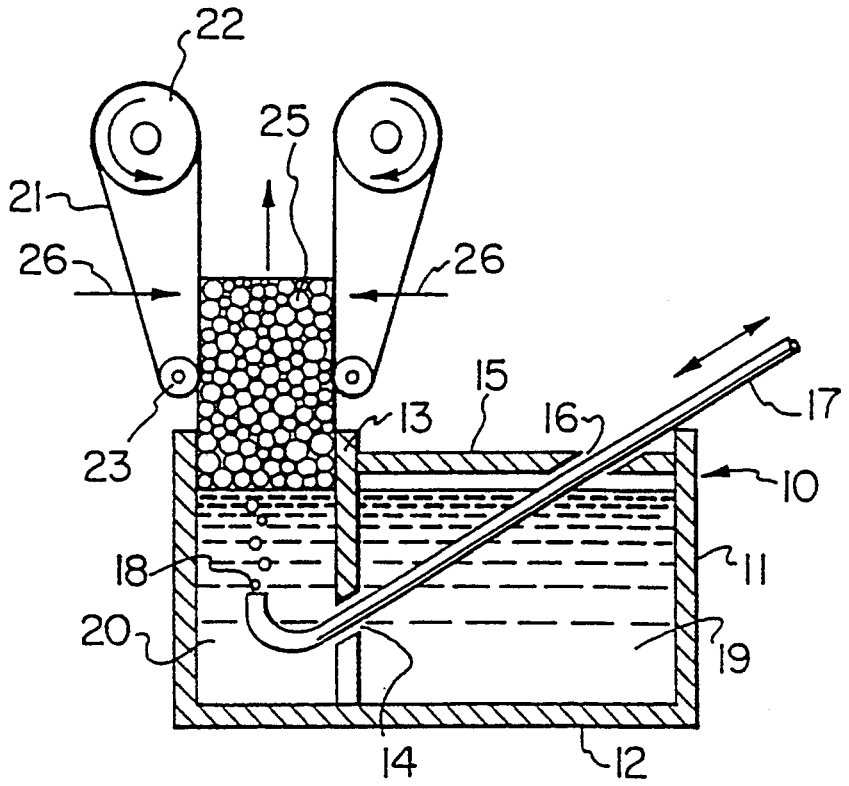
FIG. 1 illustrates schematically a first form of vertical belt apparatus for carrying out the invention.

Throughout the figures of drawings, the same reference numerals are used to represent the same components. As seen in FIG. 1, the apparatus of the invention includes a heat resistant vessel 10 having end walls 11, a bottom wall 12 and side walls (not shown). A divider wall 13 extends across between the side walls to form a foaming chamber 20 and a holding chamber 19. The holding chamber 19, which includes a cover panel 15 holds a composite of molten metal matrix and finely divided solid stabilizer particles. Fresh composite is added to chamber 19 as needed. An air injection shaft 17 extends down into the foaming chamber at an angle, preferably about 30°–45° to the horizontal, and is in the form of a hollow tube with a gas outlet nozzle 18 at the lower end thereof. This air injection shaft 17 is mounted through holes 16 and 14 in panels 15 and 13 respectively. The hollow shaft 17 can vibrate or reciprocate as shown. If necessary, additional heat may be applied to vessel 10.

Air bubbles are produced by vibrating or reciprocating nozzle 18 while flowing air therethrough and these bubbles float to the surface of the composite in the foaming chamber 20 to produce a closed cell foam 25.

Because of the strong and resilient nature of the stabilized liquid foam produced from the composite in the foaming chamber, this foam can be simply drawn off vertically from the surface of the foaming chamber 20 between a pair of moving endless belts 21. These belts are preferably mounted on drive rolls 22 and idler rolls 23 such as to form a flat slab of foamed metal between the belts 21. The belts 21 may conveniently be made of steel or glass cloth.

It is quite surprising that the stabilized liquid foam forming at the surface of the foaming chamber has the structural integrity to simply be drawn off in a vertical manner between a pair of moving belts.

Figure 2:
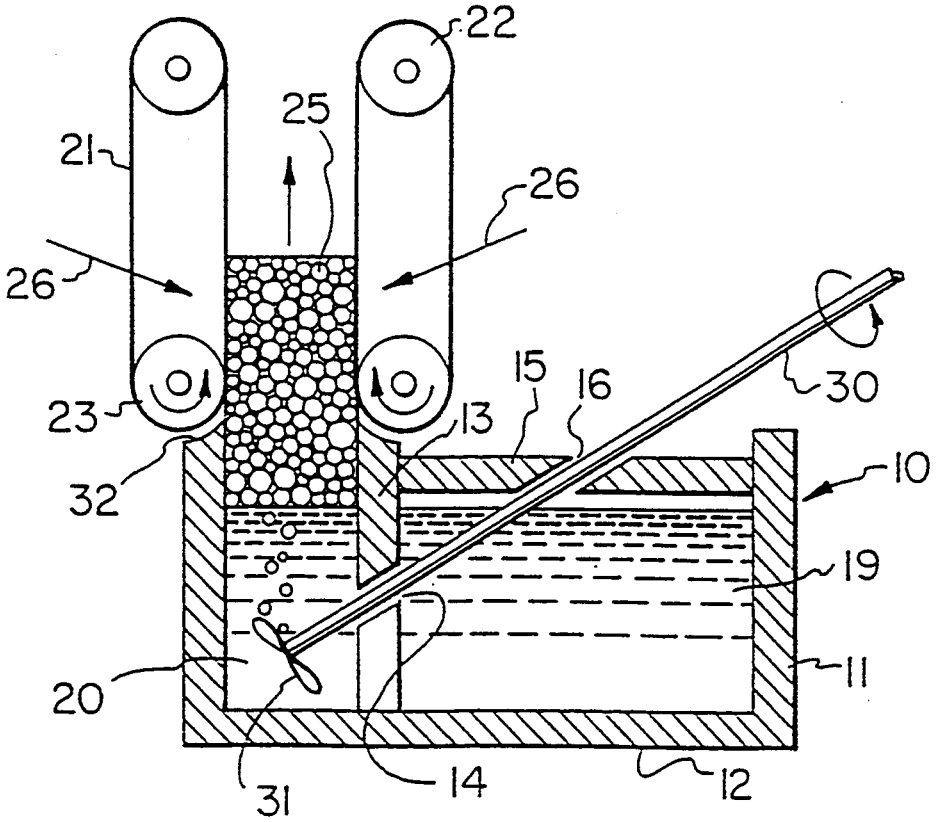
FIG. 2 illustrates schematically a second vertical belt apparatus for carrying out the invention.

An alternative form of the apparatus of this invention is shown in FIG. 2. Here, the basic vessel 10 is the same as that shown in FIG. 1 with an inclined hollow tube 30 having an impeller 31 mounted on the lower end thereof for injecting air and mixing. The air is discharged in the vicinity of the impeller 31 whereby the shearing action of the impeller creates the desired bubbles. In this design, the upper ends of end wall 11 and divider wall 13 are contoured to substantially match the diameter of drive rolls 23 for belts 21, thereby eliminating any gap between the outlet of the foaming chamber and the inlet to the belts. These belts 21 move around the drive rolls 23 and the idler rolls 22.

Figure 3:
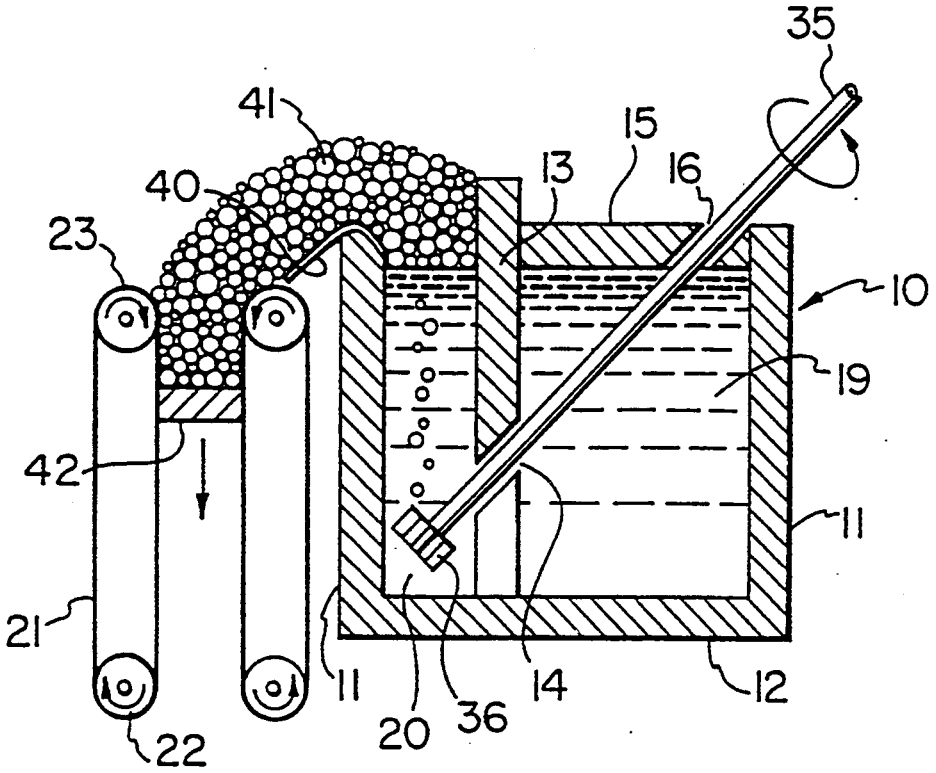
FIG. 3 illustrates schematically a third vertical belt apparatus for carrying out the invention.

It is also possible to cast the foam slab in the downward direction as shown in FIG. 3. The same basic vessel 10 is used as in FIG. 1, with modifications to divider wall 13 and end wall 11 of the foaming chamber 20. Thus, the divider wall 13 is increased in height, while the top edge of wall 11 is contoured and supports a foam trough 40 having side walls not shown. This trough 40 carries stabilized liquid foam 41 from foaming chamber 20 into the top end of a gap between a pair of downwardly moving belts 21 moving on rolls 22 and 23. At the start of a production run using this system, a support block 42 must be provided between the belts 21 to initially hold the liquid foam before it hardens.

The air injection system of this embodiment includes a hollow, rotatable shaft 35 set at an angle with an impeller 36 mounted on the lower end thereof. Air is injected into the molten composite through openings in the impeller 36.

Figure 3A:
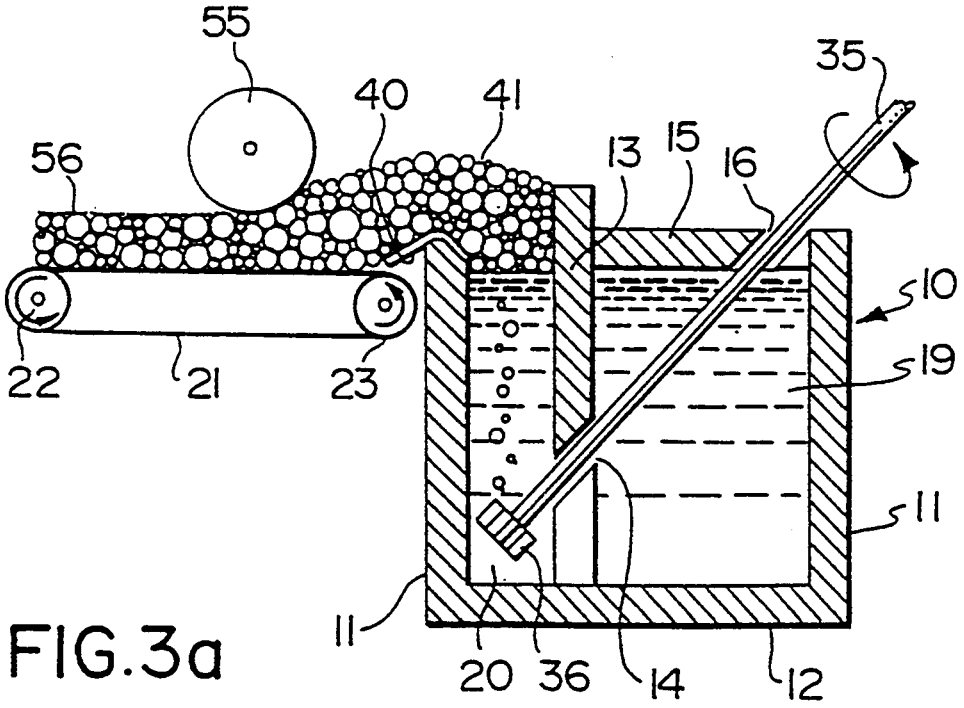
FIG. 3*a* illustrates schematically a horizontal belt and roller apparatus for carrying out the invention.

FIG. 3*a* shows a horizontal arrangement with a belt 21 travelling horizontally on drive rolls 22, 23. The same basic vessel 10 is used as in FIG. 3 but in this design the trough 40 carries stabilized liquid foam 41 from the foaming chamber 20 onto the moving horizontal belt 21. A cylindrical roll 55 is also positioned above belt 21 and this roll may be water-cooled and it may also be motorized. This roll 55 serves to flatten the top surface of the foam to form a slab 56 with a flat skin on both top and bottom faces. It is also possible to omit the roll 55 and this results in a slab having only a flat skin on the bottom face.

Figure 4:
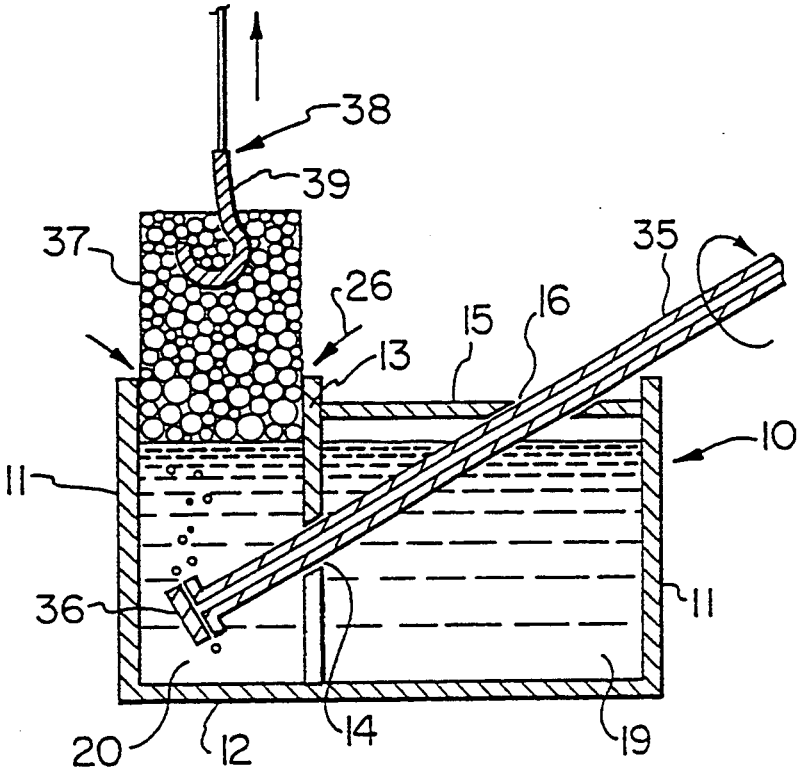
FIG. 4 illustrates schematically a vertical lift design of apparatus for carrying out the invention.

In the device of FIG. 4, the holding chamber 19 and foaming chamber 20 are similar to those shown in FIG. 1. The air injector system consisting of hollow shaft 35 and impeller 36 are similar to that of FIG. 3.

The difference in the device of FIG. 4 is in the manner of withdrawing the foam product from the foaming chamber 20. As will be seen from FIGS. 4 and 5, a pulling member 38 is provided in the form of a chilled metal hook 39. This hook is lowered into the stabilized liquid foam 37 in the top of foaming vessel 20 and the cooling effect of the chilled hook 39 serves to solidify the surrounding foamed metal sufficiently that the pulling member 38 can be raised with the solidified foam 37. As the foam continues to rise, it assumes the shape of the top opening of the foaming chamber 20 so that the top opening becomes a shaping orifice or mould which determines the shape of the final foamed product. As the foam 37 emerges from the top opening is subjected to cooling by cooling air 26.

Figure 5:
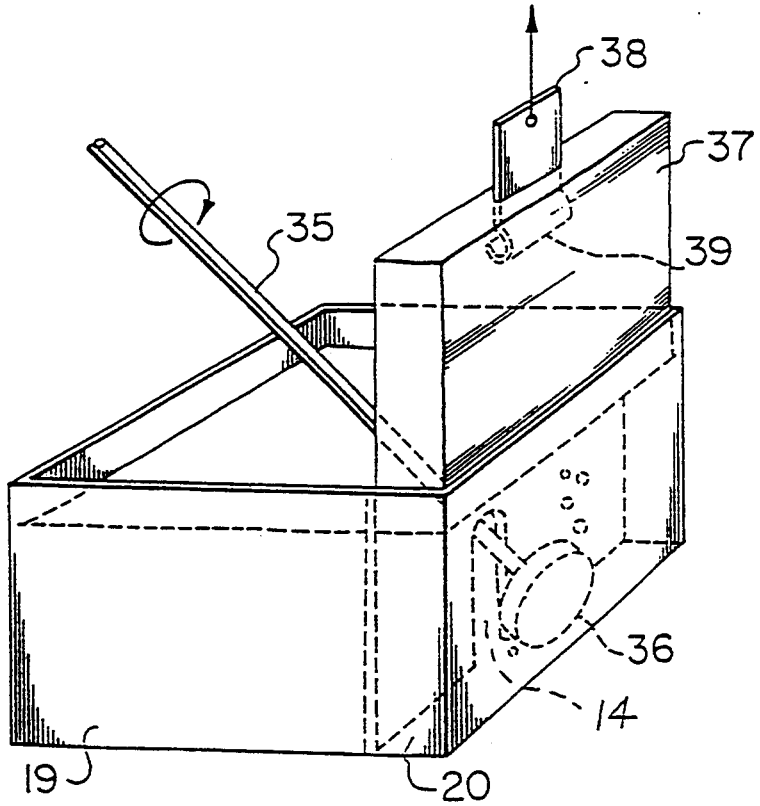
FIG. 5 is an isometric view of the device of FIG. 4.
Figure 6:
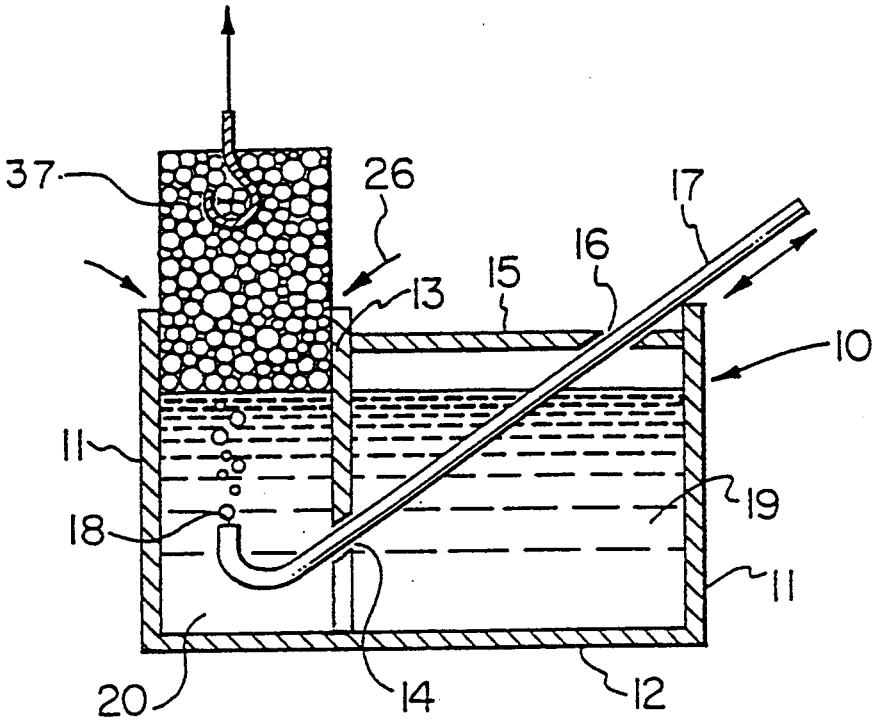
FIG. 6 illustrates schematically a further vertical lift apparatus for carrying out the invention.

The arrangement shown in FIG. 6 is essentially the same as that shown in FIGS. 4 and 5 except that the rotary air injector has been replaced by the reciprocating hollow injection shaft 17 as described in FIG. 1.

The device of FIG. 7 again uses the same reciprocating hollow shaft 17 as in FIG. 6, but the top end of the foaming chamber 20 has been changed. Thus an upwardly tapered insert 45 has been provided forming an orifice or mould of desired shape through which the foamed product 37 can be withdrawn to form a solidified foamed product of desired shape.

Figure 8:
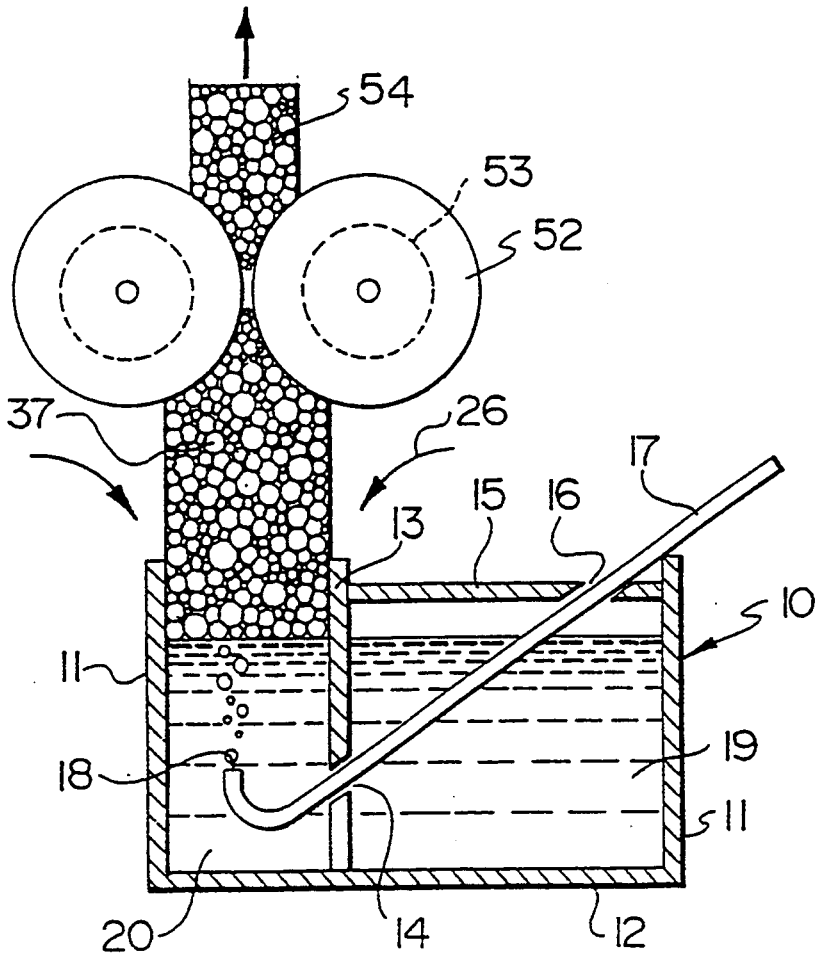
FIG. 8 illustrates a vertical lift apparatus with driven rolls between which the foam passes.

FIG. 8 shows a device having a vessel 10 and foaming chamber 20 similar to that of FIG. 6. However, the top end of the foaming chamber 20 has been changed to include a pair of rollers 52 having a profile 53 for shaping the stabilized foam 37 into a new shape 54. These rollers 52 may be powered and thereby assist in the lifting of the foam 37 in an upward direction and they may also be water-cooled. The profile 53 of the rollers 52 may be shaped such as to form the foam section 54 in circular cross-section, rectangular cross-section, etc.

Figure 7:
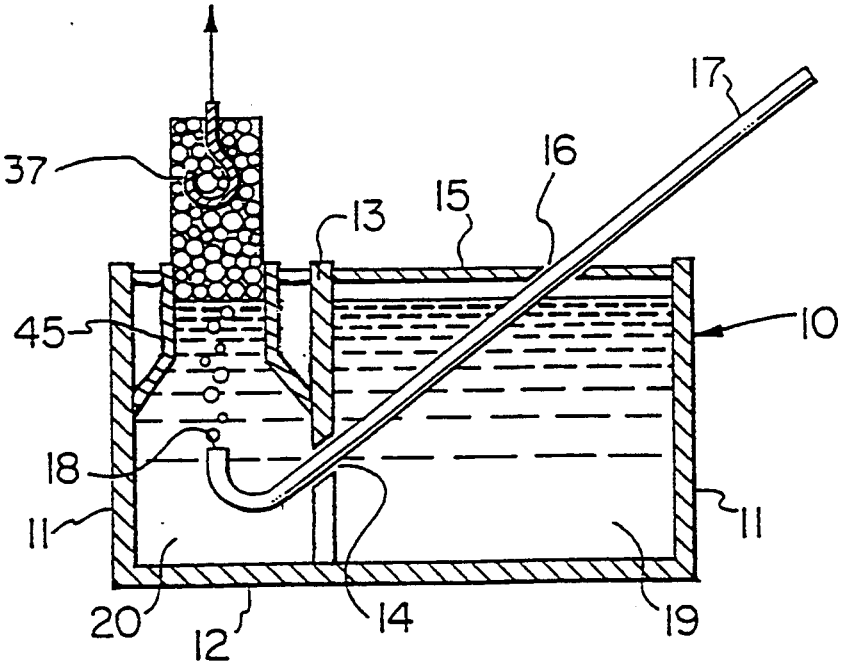
FIG. 7 illustrates a modification of the vertical lift apparatus for carrying out the invention.
Figure 9:
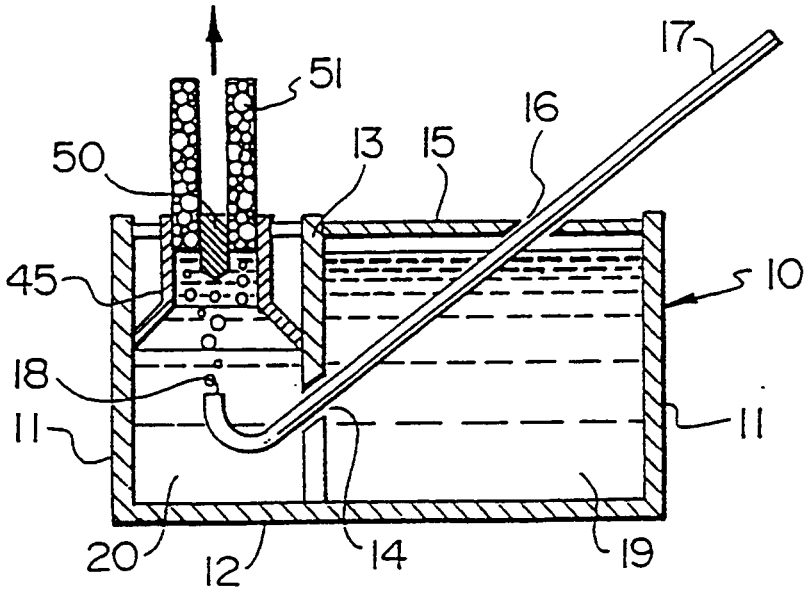
FIG. 9 illustrates an apparatus for forming hollow foam profiles.

FIG. 9 shows an embodiment generally similar to that of FIG. 7, but in this embodiment a solid plug 50 is inserted into the discharge orifice or mould such as to form the stabilized liquid foam into a hollow profile 51.

Figure 10:
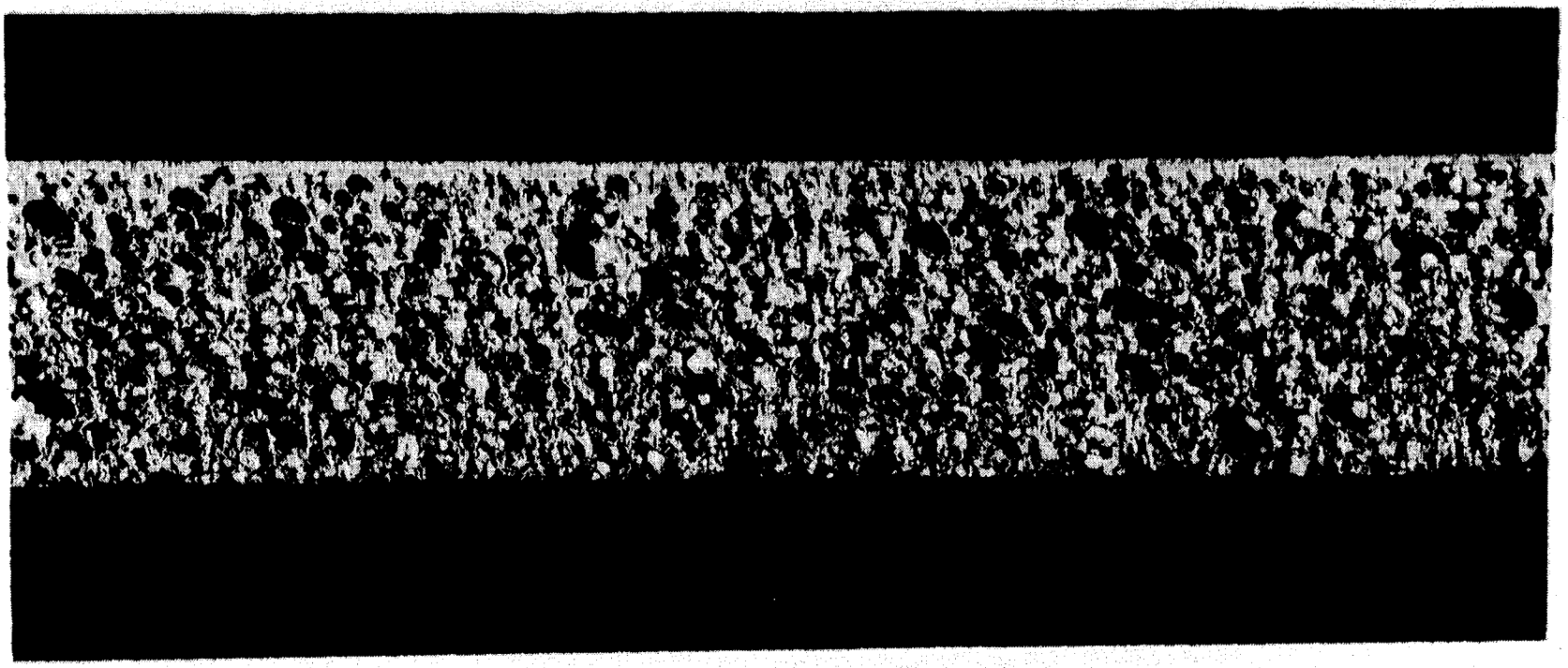
FIG. 10 is a photograph of a foamed metal slab with a homogeneous skin on one face.

FIG. 10 shows a foamed slab product formed on a substantially horizontal moving twin-belt caster. In this foamed slab, some of the liquid metal has drained to the bottom during twin-belt casting and settled on the bottom belt. There it solidified to form the homogeneous, pore-free skin which can be clearly seen along the top of the slab in FIG. 10.

We claim:

1. A process for producing a slab of foam metal wherein the foam is formed by heating a composite of a metal matrix and finely divided solid stabilizer particles above the solidus temperature of the metal matrix and discharging gas bubbles into the molten metal composite below the surface thereof to thereby form a stabilized liquid foam on the surface of the molten metal composite, characterized in that the stabilized liquid foam is continuously drawn off the surface of the molten metal composite and is continuously passed through a forming zone where it is formed into a foam product of desired cross-sectional shape.

2. A process according to claim 1 wherein the stabilized liquid foam is formed by moving it while being supported between a pair of moving belts.

3. A process according to claim 2 wherein the liquid foam is solidified while moving vertically upwardly between the belts.

4. A process according to claim 2 wherein the belts are endless belts.

5. A process according to claim 2 wherein at least one of said belts comprises a coil of sheet metal which bonds to a principal surface of the slab.

6. A process according to claim 3 wherein the belts are positioned with the bottom end of the gap therebetween engaging and drawing upwardly therebetween the liquid foam on the surface of the molten metal composite.

7. A process according to claim 1 wherein the liquid foam is solidified while moving horizontally or at an angle of no more than 45° to the horizontal either on a single belt or between a pair of belts.

8. A process according to claim 1 wherein the stabilized liquid foam is formed into a desired shape by being drawn vertically through an orifice in the top of a chamber holding the molten metal composite and liquid foam.

9. A process according to claim 8 wherein the stabilized liquid foam is drawn upwardly by means of a chilled hook member placed within the liquid foam.

10. A process according to claim 8 wherein the stabilized liquid foam is drawn upwardly between rollers.

11. A process according to claim 9 wherein the rollers are profiled to shape the emerging foam product into a desired shape.

12. A process according to claim 8 wherein the orifice contains a central plug which forms the liquid foam into a hollow profile.

13. A process according to claim 1 wherein the metal is aluminum or an alloy thereof.

14. A process according to claim 8 wherein the particles have sizes in the range of about 0.1 to 100 μm and are selected from alumina, titanium diboride, zirconia, silicon carbide and silicon nitride.

15. A process according to claim 1 wherein the gas bubbles are formed by injecting a stream of gas below the surface of the molten metal composite and forming the gas bubbles by applying a shearing action to the gas stream.

16. A process according to claim 12 wherein the shearing action is provided by means of a rotating impeller.

17. A process according to claim 12 wherein the shearing action is provided feeding the gas through a reciprocating or vibrating injection nozzle.

* * * * *